US007395878B2

(12) United States Patent
Reitsma et al.

(10) Patent No.: US 7,395,878 B2
(45) Date of Patent: Jul. 8, 2008

(54) DRILLING SYSTEM AND METHOD

(75) Inventors: Donald Gordon Reitsma, Rijswijk (NL); Egbert Jan Van Riet, Rijswijk (NL)

(73) Assignee: AT-Balance Americas, LLC, Houston, TX (US)

( * ) Notice: Subject to any disclaimer, the term of this patent is extended or adjusted under 35 U.S.C. 154(b) by 51 days.

(21) Appl. No.: 11/334,142

(22) Filed: Jan. 18, 2006

(65) Prior Publication Data

US 2006/0175090 A1 Aug. 10, 2006

Related U.S. Application Data

(63) Continuation of application No. PCT/EP2004/051614, filed on Jul. 27, 2004.

(51) Int. Cl.
*E21B 21/08* (2006.01)

(52) U.S. Cl. ..... 175/38; 175/48

(58) Field of Classification Search ..... 175/24, 175/38, 48, 207

See application file for complete search history.

(56) References Cited

U.S. PATENT DOCUMENTS

| | | | | |
|---|---|---|---|---|
| 296,564 | A | 4/1884 | Hemje | |
| 553,128 | A | 1/1896 | McDonald | |
| 2,169,223 | A | 8/1939 | Christian | 255/61 |
| 2,628,129 | A | 2/1953 | Hosmer et al. | 299/84 |
| 2,946,565 | A | 7/1960 | Williams | 255/1.8 |
| 3,354,970 | A | 11/1967 | Lummus | 175/218 |
| 3,365,009 | A | 1/1968 | Bumham et al. | 175/206 |
| 3,429,387 | A | 2/1969 | Brown | 175/237 |
| 3,443,643 | A | 5/1969 | Jones | 175/25 |
| 3,470,971 | A | 10/1969 | Dower | 175/25 |

(Continued)

FOREIGN PATENT DOCUMENTS

| | | |
|---|---|---|
| DE | 19813087 | 9/1999 |

(Continued)

OTHER PUBLICATIONS

U.S. Appl. No. 60/358,226, filed Feb. 20, 2002.

(Continued)

*Primary Examiner*—William P. Neuder
(74) *Attorney, Agent, or Firm*—Osha Liang, LLP

(57) ABSTRACT

Drilling system and method for drilling a bore hole into an earth formation, the bore hole having an inside wall. A drill string reaches into the bore hole and leaves a drilling fluid return passage between the drill string and the bore hole inside wall. A drilling fluid discharge conduit is in fluid communication with the drilling fluid return passage, and pump means are provided for pumping a drilling fluid through the drill string into the bore hole and to the drilling fluid discharge conduit via the drilling fluid return passage. The drilling fluid back pressure is controlled utilizing back pressure control means for controlling back pressure means. The system further provides fluid injection means comprising an injection fluid supply passage fluidly connecting an injection fluid supply with the drilling fluid return passage and further comprising an injection fluid pressure sensor arranged to provide a pressure signal in accordance with an injection fluid pressure in the injection fluid supply passage. The back pressure control means is arranged to receive the pressure signal and to regulate the back pressure means in dependence of at least the pressure signal.

19 Claims, 6 Drawing Sheets

U.S. PATENT DOCUMENTS

| | | | | |
|---|---|---|---|---|
| 3,488,765 | A | 1/1970 | Anderson | 175/61 |
| 3,497,020 | A | 2/1970 | Kammerer, Jr. | 175/69 |
| 3,508,577 | A | 4/1970 | Vincent et al. | 137/528 |
| 3,552,402 | A | 1/1971 | Levy | |
| 3,559,739 | A | 2/1971 | Hutchison | 166/311 |
| 3,677,353 | A | 7/1972 | Baker | 175/25 |
| 3,738,436 | A | 6/1973 | Litchfield et al. | |
| 3,827,511 | A | 8/1974 | Jones | 175/25 |
| 3,868,832 | A | 3/1975 | Biffle | 64/23.5 |
| 4,310,058 | A * | 1/1982 | Bourgoyne, Jr. | 175/48 |
| 4,315,553 | A | 2/1982 | Stallings | 175/207 |
| 4,406,595 | A | 9/1983 | Robertson et al. | 417/383 |
| 4,460,318 | A | 7/1984 | Horton | |
| 4,611,578 | A | 9/1986 | Heimes et al. | |
| 4,630,675 | A | 12/1986 | Neipling et al. | 166/53 |
| 4,630,691 | A | 12/1986 | Hooper | 175/65 |
| 4,653,597 | A | 3/1987 | Johnson | 175/25 |
| 4,683,944 | A | 8/1987 | Curlett | 166/65.1 |
| 4,700,739 | A | 10/1987 | Flohr | 137/488 |
| 4,709,900 | A | 12/1987 | Dyhr | 251/5 |
| 4,739,325 | A | 4/1988 | MacLeod | |
| 4,755,111 | A | 7/1988 | Cocchi et al. | 417/394 |
| 4,924,949 | A * | 5/1990 | Curlett | 175/25 |
| 5,010,966 | A | 4/1991 | Stokley et al. | 175/66 |
| 5,048,620 | A | 9/1991 | Maher | 175/71 |
| 5,168,932 | A | 12/1992 | Worrall et al. | 166/336 |
| 5,305,836 | A | 4/1994 | Holbrook et al. | 175/39 |
| 5,348,107 | A | 9/1994 | Bailey et al. | 175/162 |
| 5,359,324 | A | 10/1994 | Clark et al. | |
| 5,437,308 | A | 8/1995 | Morin et al. | 138/46 |
| 5,443,128 | A | 8/1995 | du Chaffaut | 175/25 |
| 5,447,197 | A | 9/1995 | Rae et al. | 166/293 |
| 5,474,142 | A | 12/1995 | Bowden | 172/27 |
| 5,547,506 | A | 8/1996 | Rae et al. | 106/730 |
| 5,638,904 | A | 6/1997 | Misselbrook et al. | 166/384 |
| 5,806,612 | A | 9/1998 | Vorhoff et al. | 175/40 |
| 5,857,522 | A | 1/1999 | Bradfield et al. | 166/267 |
| 5,890,549 | A | 4/1999 | Sprehe | 175/71 |
| 5,975,219 | A | 11/1999 | Sprehe | 175/48 |
| 6,033,192 | A | 3/2000 | Wood | 417/395 |
| 6,035,952 | A | 3/2000 | Bradfield et al. | 175/66 |
| 6,102,673 | A | 8/2000 | Mott et al. | 417/392 |
| 6,119,772 | A | 9/2000 | Pruet | 166/81.1 |
| 6,119,779 | A | 9/2000 | Gipson et al. | |
| 6,176,323 | B1 | 1/2001 | Weirich et al. | 175/40 |
| 6,177,882 | B1 | 1/2001 | Ringgenberg et al. | |
| 6,189,612 | B1 | 2/2001 | Ward | 166/250.07 |
| 6,325,159 | B1 | 12/2001 | Peterman et al. | 175/7 |
| 6,352,129 | B1 | 3/2002 | Best | 175/25 |
| 6,367,566 | B1 | 4/2002 | Hill | 175/57 |
| 6,370,082 | B1 | 4/2002 | Gardner et al. | |
| 6,374,925 | B1 | 4/2002 | Elkins et al. | 175/25 |
| 6,394,195 | B1 | 5/2002 | Schubert et al. | 175/48 |
| 6,412,554 | B1 | 7/2002 | Allen et al. | 166/80.1 |
| 6,484,816 | B1 | 11/2002 | Koederitz | 175/25 |
| 6,527,062 | B2 | 3/2003 | Elkins et al. | 175/25 |
| 6,571,873 | B2 | 6/2003 | Maus | 166/250.07 |
| 6,575,244 | B2 | 6/2003 | Chang et al. | 166/250.15 |
| 6,920,942 | B2 * | 7/2005 | Koederitz | 175/25 |
| 2001/0050185 | A1 | 12/2001 | Calder et al. | 175/5 |
| 2002/0011288 | A1 * | 8/2002 | Leuchtenberg | 175/48 |
| 2002/0108783 | A1 | 8/2002 | Elkins et al. | 175/25 |
| 2002/0112888 | A1 | 8/2002 | Leuchtenberg | 175/48 |
| 2003/0079912 | A1 | 5/2003 | Beuchtenberg | 175/38 |
| 2003/0098181 | A1 | 5/2003 | Aronstam et al. | 175/65 |
| 2003/0181338 | A1 | 9/2003 | Sweatman et al. | 507/100 |
| 2004/0005667 | A1 | 1/2004 | Ratti et al. | |
| 2004/0069504 | A1 | 4/2004 | Krueger et al. | 166/387 |
| 2007/0151763 | A1 * | 7/2007 | Reitsma et al. | 175/48 |

FOREIGN PATENT DOCUMENTS

| | | |
|---|---|---|
| EP | 0030557 | 5/1983 |
| EP | 0436242 | 7/1991 |
| EP | 0298673 B1 | 12/1991 |
| EP | 0947750 | 10/1999 |
| EP | 1271488 | 1/2003 |
| GB | 2323870 | 10/1998 |
| SU | 1579979 | 7/1990 |
| WO | 9742395 | 11/1997 |
| WO | WO9816716 | 4/1998 |
| WO | 9828517 | 7/1998 |
| WO | WO9934090 | 7/1999 |
| WO | 00/04269 | 1/2000 |
| WO | 00/79092 | 12/2000 |
| WO | 01/20120 | 3/2001 |
| WO | 00/75477 | 12/2001 |
| WO | 02/50395 | 6/2002 |
| WO | 02/50398 | 6/2002 |
| WO | 02/084067 | 10/2002 |
| WO | 03/025334 | 3/2003 |
| WO | 03/071091 | 8/2003 |
| WO | 03071091 | 8/2003 |
| WO | 2004/005667 | 1/2004 |
| WO | WO2004074627 A1 | 9/2004 |

OTHER PUBLICATIONS

G.V. Chilingarian and P. Vorabutr, "Drilling and Drilling Fluids", Elsevier Scientific Publishing Company, pp. 44-47.

Chester L. Nachtigal, "Instrumentation and Control - Fundamentals and Applications", Wiley-Interscience Publication, p. 541.

Gerd Schaumberg, Bohrloch Kontroll Handbuch, Band 1, 8-9,27-33,38-40,43-48, 59-61 103-108, 113-116, 129-130, 155-158.

Gerd Schaumberg, Bohrloch Kontroll Handbuch, Band 2, pp.47-50, and 89-90.

W.C. Goins, Jr., "Blowout Prevention", Technology, vol. 1, dated 1969, pp. 10-11.

* cited by examiner

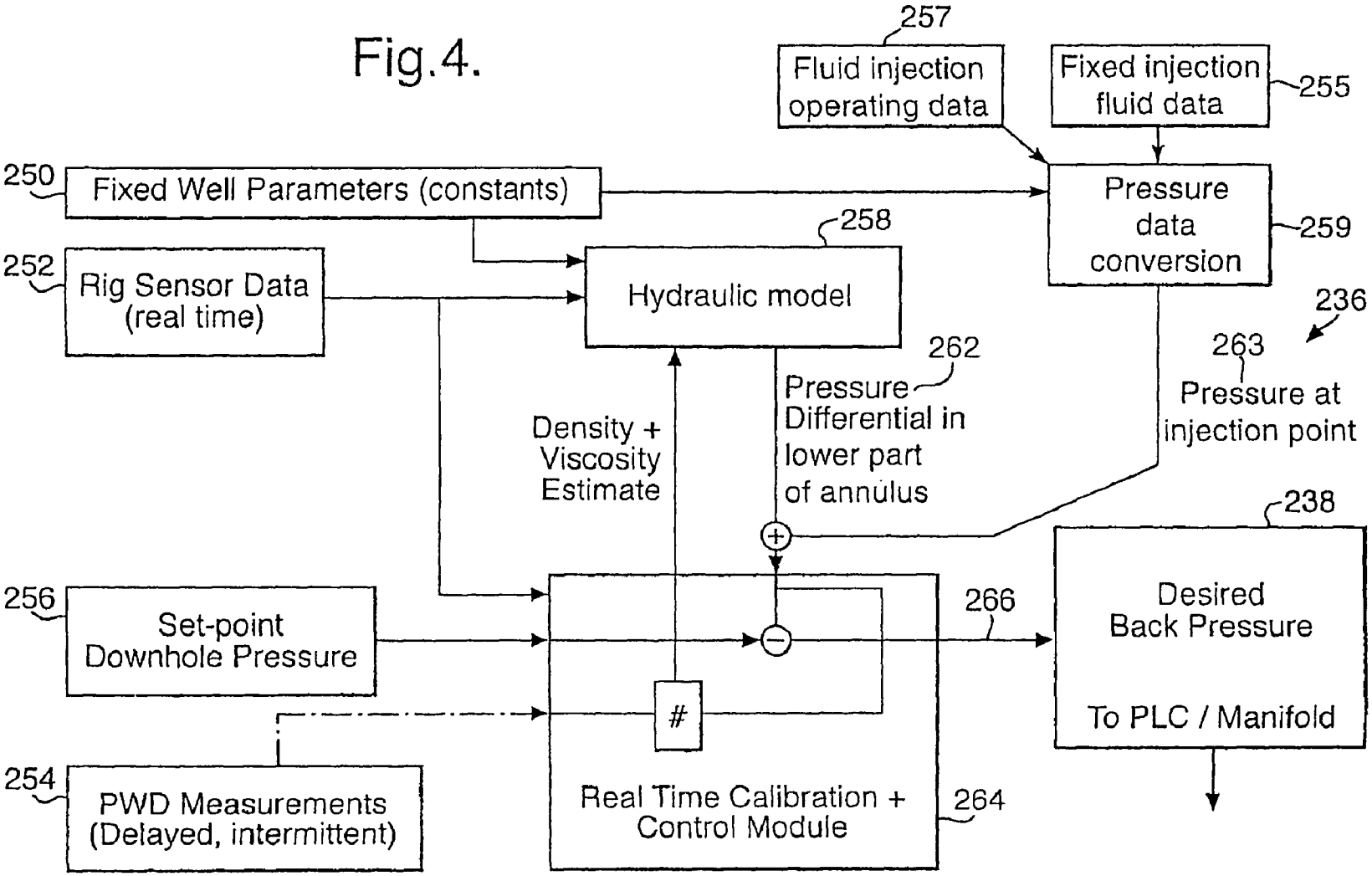
Fig.4.
Fixed Well Parameters (constants)
250
Rig Sensor Data (real time)
252
Fluid injection operating data
257
Fixed injection fluid data
255
Hydraulic model
258
Pressure data conversion
259
236
Pressure at injection point
263
Pressure Differential in lower part of annulus
262
Density + Viscosity Estimate
Set-point Downhole Pressure
256
PWD Measurements (Delayed, intermittent)
254

Real Time Calibration + Control Module
264
266
Desired Back Pressure
238
To PLC / Manifold

DRILLING SYSTEM AND METHOD

CROSS REFERENCE TO PRIOR APPLICATIONS

This application is a continuation of International application No. PCT/EP2004/051614, filed 27 Jul. 2004, which claims priority of European application No. 03077606.6, filed 19 Aug. 2003.

FIELD OF THE INVENTION

The present invention relates to a drilling system and method for drilling a bore hole into an earth formation.

BACKGROUND OF THE INVENTION

The exploration and production of hydrocarbons from subsurface formations ultimately requires a method to reach for and extract the hydrocarbons from the formation. This is typically achieved by drilling a well with a drilling rig. In its simplest form, this constitutes a land-based drilling rig that is used to support and rotate a drill string, comprised of a series of drill tubulars with a drill bit mounted at the end. Furthermore, a pumping system is used to circulate a fluid, comprised of a base fluid, typically water or oil, and various additives down the drill string, the fluid then exits through the rotating drill bit and flows back to surface via the annular space formed between the borehole wall and the drill string. The drilling fluid serves the following purposes: (a) provide support to the borehole wall, (b) prevent or, in case of under balanced drilling (UBD), control formation fluids or gasses from entering the well, (c) transport the cuttings produced by the drill bit to surface, (d) provide hydraulic power to tools fixed in the drill string and (e) cooling of the bit. After being circulated through the well, the drilling fluid flows back into a mud handling system, generally comprised of a shaker table, to remove solids, a mud pit and a manual or automatic means for addition of various chemicals or additives to keep the properties of the returned fluid as required for the drilling operation. Once the fluid has been treated, it is circulated back into the well via re-injection into the top of the drill string with the pumping system.

During drilling operations, the drilling fluid exerts a pressure against the well bore inside wall that is mainly built-up of a hydrostatic part, related to the weight of the mud column, and a dynamic part related frictional pressure losses caused by, for instance, the fluid circulation rate or movement of the drill string.

The fluid pressure in the well is selected such that, while the fluid is static or circulated during drilling operations, it does not exceed the formation fracture pressure or formation strength. If the formation strength is exceeded, formation fractures will occur which will create drilling problems such as fluid losses and borehole instability. On the other hand, in overbalanced drilling the fluid density is chosen such that the pressure in the well is always maintained above the pore pressure to avoid formation fluids entering the well, while during UBD the pressure in the well is maintained just below the power pressure to controllably allow formation fluids entering the well (primary well control).

The pressure margin with on one side the pore pressure and on the other side the formation strength is known as the "Operational Window".

For reasons of safety and pressure control, a Blow-Out Preventer (BOP) can be mounted on the well head, below the rig floor, which BOP can shut off the wellbore in case formation fluids or gas should enter the wellbore (secondary well control) in an unwanted or uncontrolled way. Such unwanted inflows are commonly referred to as "kicks". The BOP will normally only be used in emergency i.e. well-control situations.

In U.S. Pat. No. 6,035,952, to Bradfield et al. and assigned to Baker Hughes Incorporated, a closed well bore system is used for the purposes of underbalanced drilling, i.e., the annular pressure is maintained below the formation pore pressure.

In U.S. Pat. No. 6,352,129 (Shell Oil Company) a method and system are described to control the fluid pressure in a well bore during drilling, using a back pressure pump in fluid communication with an annulus discharge conduit, in addition to a primary pump for circulating drilling fluid through the annulus via the drill string.

An accurate control of the fluid pressure in the well bore is facilitated by an accurate knowledge of the down hole pressure. However, in a borehole with a variably rotating drill string, and with possibly all kinds of down hole subs that are driven by the drilling fluid circulation flow, it is a problem to monitor the down hole pressure in real time. Measurements of the pressure of the drilling fluid in the drill string, or in the bore hole, close to the surface level are often too far removed from the lower end of the bore hole to provide an accurate basis for calculating or estimating the actual down hole pressure. On the other hand, the currently available data transfer rates are too low for using direct down hole pressure data taken by a measurement while drilling sensor as a real-time feed back control signal.

It is thus an object of the invention to provide a system and a method for drilling a bore hole into an earth formation that allows for improved control of the fluid pressure in the well bore.

SUMMARY OF THE INVENTION

According to the invention, there is provided a drilling system for drilling a bore hole into an earth formation, the bore hole having an inside wall, and the system comprising:

- a drill string reaching into the bore hole leaving a drilling fluid return passage between the drill string and the bore hole inside wall;
- a drilling fluid discharge conduit in fluid communication with the drilling fluid return passage;
- pump means for pumping a drilling fluid through the drill string into the bore hole and to the drilling fluid discharge conduit via the drilling fluid return passage;
- back pressure means for controlling the drilling fluid back pressure;
- fluid injection means comprising an injection fluid supply passage fluidly connecting an injection fluid supply to the drilling fluid return passage and further comprising an injection fluid pressure sensor arranged to provide a pressure signal in accordance with an injection fluid pressure in the injection fluid supply passage;
- back pressure control means for controlling the back pressure means whereby the back pressure control means is arranged to receive the pressure signal and to regulate the back pressure means in dependence of at least the pressure signal.

The invention also provides a drilling method for drilling a bore hole into an earth formation, the bore hole having an inside wall, the drilling method comprising the steps of:

- deploying a drill string into the bore hole and forming a drilling fluid return passage between the drill string and the bore hole inside wall;
- pumping a drilling fluid through the drill string into the bore hole and via the drilling fluid return passage to a drilling fluid discharge conduit arranged in fluid communication with the drilling fluid return passage;

controlling a drilling fluid back pressure by controlling back pressure means;

injecting an injection fluid from an injection fluid supply via an injection fluid supply passage into the drilling fluid in the drilling fluid return passage;

generating a pressure signal in accordance with an injection fluid pressure in the injection fluid supply passage;

controlling the back pressure means, which controlling comprises regulating the back pressure means in dependence of at least the pressure signal.

BRIEF DESCRIPTION OF THE DRAWING

The invention will now be illustrated by way of example, with reference to the accompanying drawing wherein

FIG. 4 is a functional diagram of the operation of the pressure monitoring and control system;

In these figures, like parts carry identical reference numerals.

DETAILED DESCRIPTION OF EMBODIMENTS

Figure 1:
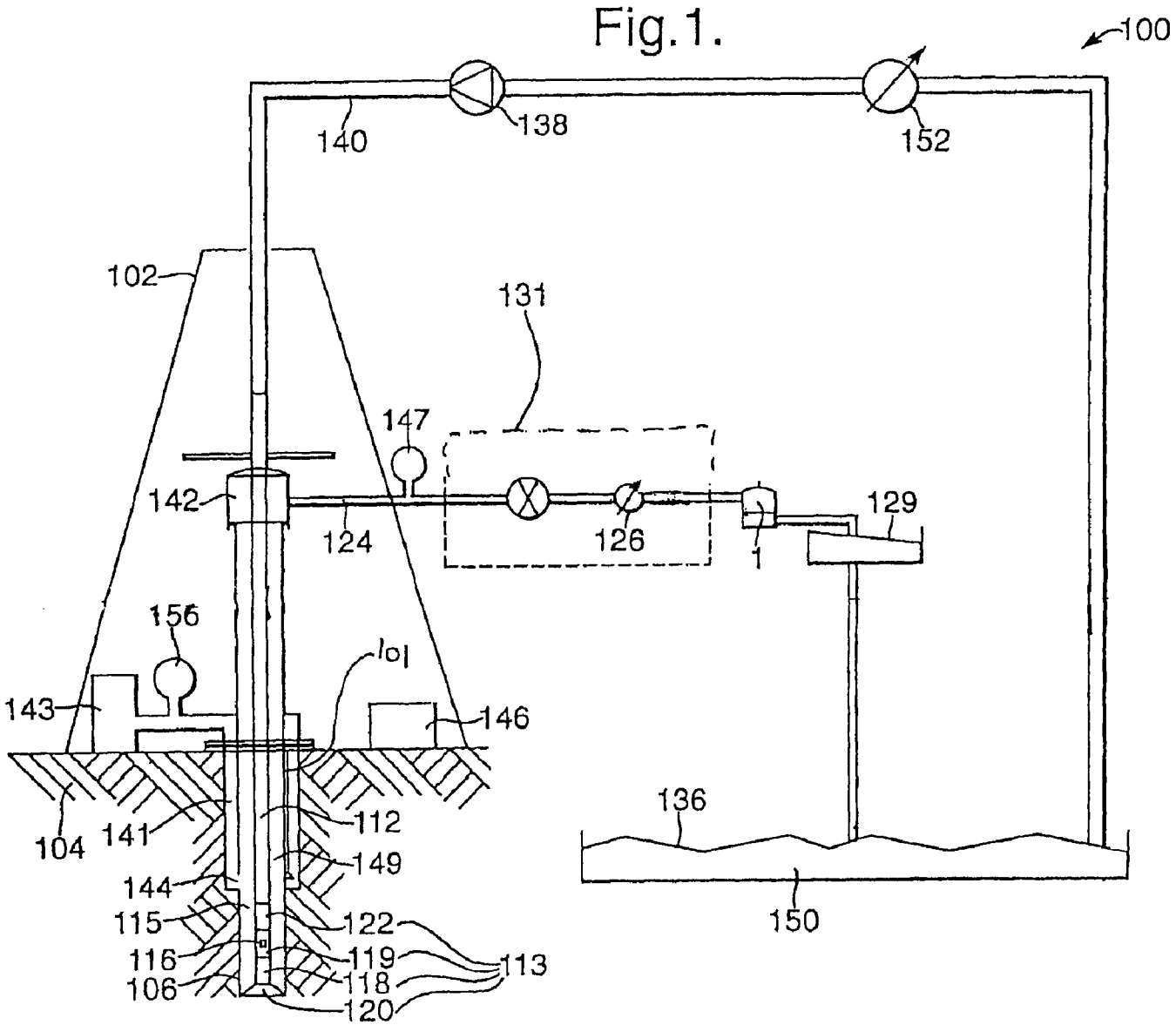
FIG. 1 is a schematic view of a drilling apparatus according to an embodiment of the invention.

FIG. 1 is a schematic view depicting a surface drilling system 100 employing the current invention. It will be appreciated that an offshore drilling system may likewise employ the current invention.

The drilling system 100 is shown as being comprised of a drilling rig 102 that is used to support drilling operations. Many of the components used on a rig 102, such as the kelly, power tongs, slips, draw works and other equipment are not shown for ease of depiction. The rig 102 is used to support drilling and exploration operations in a formation 104. A borehole 106 has already been partially drilled.

A drill string 112 reaches into the bore bole 106, thereby forming a well bore annulus between the bore hole wall and the drill string 112, and/or between an optional casing 101 and the drill string 112. One of the functions of the drill string 112 is to convey a drilling fluid 150, the use of which is required in a drilling operation, to the bottom of the bore hole and into the well bore annulus.

The drill string 112 supports a bottom hole assembly (BHA) 113 that includes a drill bit 120, a mud motor 118, a sensor package 119, a check valve (not shown) to prevent backflow of drilling fluid from the well bore annulus into the drill string.

The sensor package 119 may for instance be provided in the form of a MWD/LWD sensor suite. In particular it may include a pressure transducer 116 to determine the annular pressure of drilling fluid in or near the bottom of the hole.

The BHA 113 in the shown embodiment also includes a telemetry package 122 that can be used to transmit pressure information, MWD/LWD information as well as drilling information to be received at the surface. A data memory including a pressure data memory may be provided for temporary storage of collected pressure data before transmittal of the information.

The drilling fluid 150 may be stored in a reservoir 136, which in FIG. 1 is depicted in the form of a mud pit. The reservoir 136 is in fluid communications with pump means, particularly primary pump means, comprising one or more mud pumps 138 that, in operation, pump the drilling fluid 150 through a conduit 140. An optional flow meter 152 can be provided in series with one or more mud pumps, either upstream or downstream thereof. The conduit 140 is connected to the last joint of the drill string 112.

During operation, the drilling fluid 150 is pumped down through the drill string 112 and the BHA 113 and exits the drill bit 120, where it circulates the cuttings away from the bit 120 and returns them up a drilling fluid return passage 115 which is typically formed by the well bore annulus. The drilling fluid 150 returns to the surface and goes through a side outlet, through drilling fluid discharge conduit 124 and optionally through various surge tanks and telemetry systems (not shown).

Figure 2:
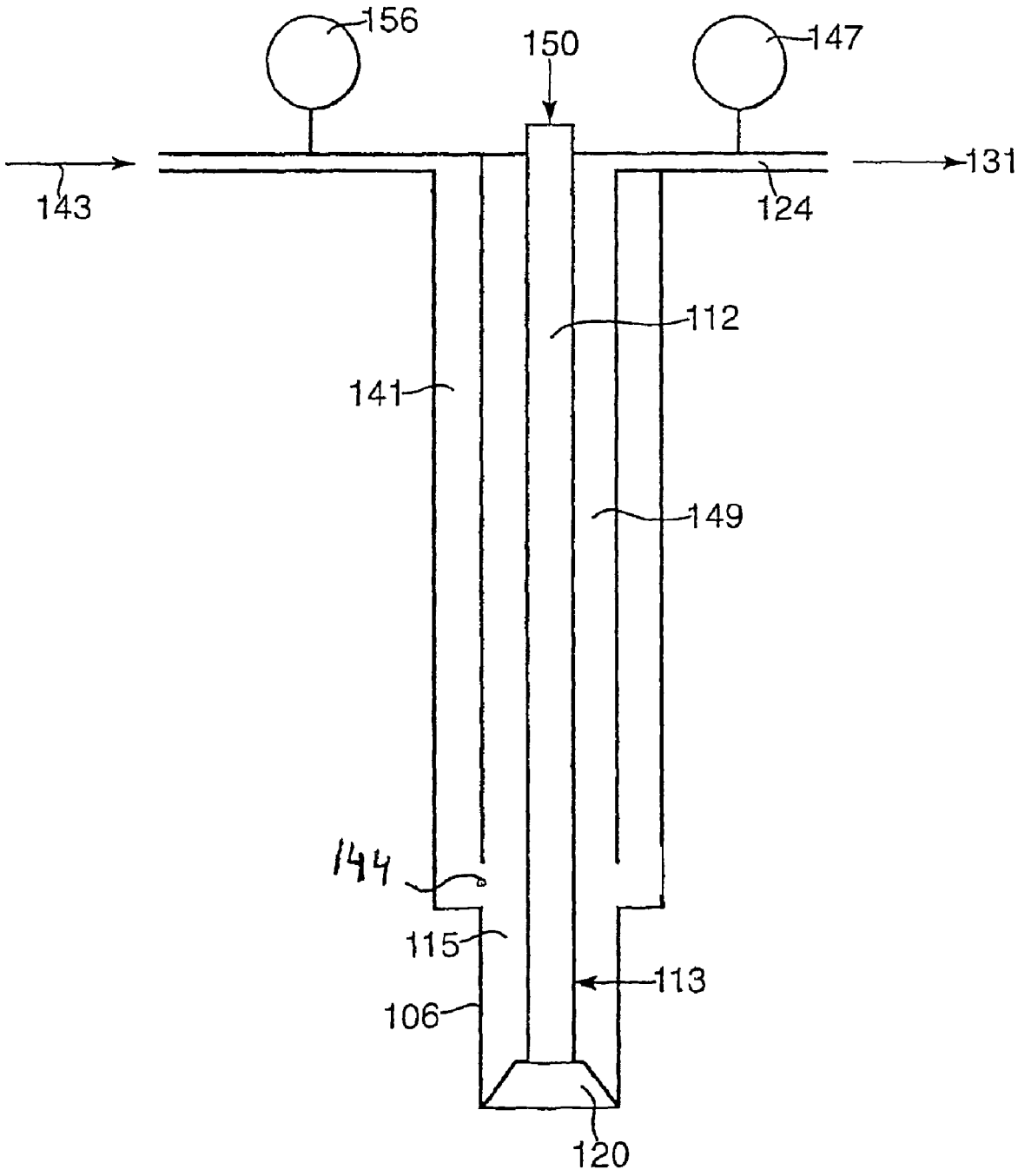
FIG. 2 schematically shows a schematic well configuration in a drilling system in accordance with an embodiment of the invention.

Referred is now also to FIG. 2, showing schematically the following details of the well configuration that relate to an injection fluid injection system for injecting an injection fluid into the drilling fluid that is contained in the drilling fluid return passage. An injection fluid supply passage is provided in the form of an outer annulus 141. The outer annulus 141 fluidly connects an injection fluid supply 143 with the drilling fluid return passage 115, in which gap an injection fluid can be injected through injection point 144. Suitably, the injection fluid supply 143 is located on the surface.

A variable flow-restricting device, such as an injection choke or an injection valve, is optionally provided to separate the injection fluid supply passage 141 from the drilling fluid return passage 115. Herewith it is achieved that injection of the injection fluid into the drilling fluid can be interrupted while maintaining pressurisation of the injection fluid supply passage.

Suitably, the injection fluid has a lower density than the drilling fluid, such that the hydrostatic pressure in the bottom hole area, in the vicinity of the drill bit 120, is reduced due to a lower weight of the body of fluid present in the fluid return passage 115.

Suitably, the injection fluid is injected in the form of a gas, which can be, for example, nitrogen gas. An injection fluid pressure sensor 156 is provided, in fluid communication with the injection fluid supply passage, for monitoring a pressure of the injection fluid in the injection fluid supply passage 144. The injection fluid supply passage 141 is led to the surface level on the rig, so that the injection fluid pressure sensor 156 can be located at the surface level and the pressure data generated by the injection fluid pressure sensor 156 is readily available at surface.

During circulation of the drilling fluid 150 through the drill string 112 and bore hole 106, a mixture of drilling fluid 150, possibly including cuttings, and the injection fluid flows through an upper part 149 of the annulus 115, down stream of the injection point 144. Thereafter the mixture proceeds to what is generally referred to as the backpressure system 131.

A pressure isolating seal is provided to seal against the drill string and contain a pressure in the well bore annulus. In the embodiment of FIG. 1, the pressure isolating seal is provided in the form of a rotating control head on top of the BOP 142, through which rotating control head the drill string passes. The rotating control head on top of the BOP forms, when activated, a seal around the drill string 112, isolating the pressure, but still permitting drill string rotation and reciprocation. Alternatively a rotating BOP may be utilized. The pressure isolating seal can be regarded to be a part of the back pressure system.

Referring to FIG. 1, as the mixture returns to the surface it goes through a side outlet below the pressure isolating seal to back pressure means arranged to provide an adjustable back pressure on the drilling fluid mixture contained in the well bore annulus 115. The back pressure means comprises a variable flow restrictive device, suitably in the form of a wear resistant choke 130. It will be appreciated that there exist chokes designed to operate in an environment where the drilling fluid 150 contains substantial drill cuttings and other solids. Choke 130 is one such type and is further capable of operating at variable pressures, flowrates and through multiple duty cycles.

The drilling fluid 150 exits the choke 130 and flows through an optional flow meter 126 to be directed through an optional degasser 1 and solids separation equipment 129. Optional degasser 1 and solids separation equipment 129 are designed to remove excess gas and other contaminates, including cuttings, from the drilling fluid 150. After passing solids separation equipment 129, the drilling fluid 150 is returned to reservoir 136.

Flow meter 126 may be a mass-balance type or other high-resolution flow meter. A back pressure sensor 147 can be optionally provided in the drilling fluid discharge conduit 124 upstream of the variable flow restrictive device. A flow meter, similar to flow meter 126, may be placed upstream of the back pressure means 131 in addition to the back pressure sensor 147.

Back pressure control means including a pressure monitoring system 146 are provided for monitoring data relevant for the annulus pressure, and providing control signals to at least the back pressure system 131 and optionally also to the injection fluid injection system and/or to the primary pump means.

The ability to provide adjustable back pressure during the entire drilling and completing process is a significant improvement over conventional drilling systems, in particular in relation to UBD where the drilling fluid pressure must be maintained as low as possible in the operational window.

In general terms, the required back pressure to obtain the desired down hole pressure is determined by obtaining information on the existing down hole pressure of the drilling fluid in the vicinity of the BHA 113, referred to as the bottom hole pressure, comparing the information with a desired down hole pressure and utilizing the differential between these for determining a set-point back pressure and controlling the back pressure means in order to establish a back pressure close to the set-point back pressure.

The injection fluid pressure in the injection fluid supply passage represents a relatively accurate indicator for the drilling fluid pressure in the drilling fluid gap at the depth where the injection fluid is injected into the drilling fluid gap. Therefore, a pressure signal generated by an injection fluid pressure sensor anywhere in the injection fluid supply passage can be suitably utilized, for instance as an input signal for controlling the back pressure means, for monitoring the drilling fluid pressure in the drilling fluid return passage.

The pressure signal can, if so desired, optionally be compensated for the weight of the injection fluid column and/or for the dynamic pressure loss that may be generated in the injection fluid between the injection fluid pressure sensor in the injection fluid supply passage and where the injection into the drilling fluid return passage takes place, for instance, in order to obtain an exact value of the injection pressure in the drilling fluid return passage at the depth where the injection fluid is injected into the drilling fluid gap.

The pressure of the injection fluid in the injection fluid supply passage 141 is advantageously utilized for obtaining information relevant for determining the current bottom hole pressure. As long as the injection fluid is being injected into the drilling fluid return stream, the pressure of the injection fluid at the injection depth can be assumed to be equal to the drilling fluid pressure at the injection point 144. Thus, the pressure as determined by injection fluid pressure sensor 156 can advantageously be utilized to generate a pressure signal for use as a feedback signal for controlling or regulating the back pressure system.

It is remarked that the change in hydrostatic contribution to the down hole pressure that would result from a possible variation in the injection fluid injection rate, is in close approximation compensated by the above described controlled re-adjusting of the back pressure means. Thus by controlling the back pressure means in accordance with the invention, the fluid pressure in the bore hole is almost independent of the rate of injection fluid injection.

One possible way to utilize the pressure signal corresponding to the injection fluid pressure, is to control the back pressure system so as to maintain the injection fluid pressure on a certain suitable constant value throughout the drilling or completion operation. The accuracy is increased when the injection point 144 is in close proximity to the bottom of the bore hole.

When the injection point 144 is not so close to the bottom of the bore hole, the magnitude of the pressure differential over the part of the drilling fluid return passage stretching between the injection point 144 and the bottom of the hole is preferably to be established. For this, a hydraulic model can be utilized as will be described below.

In a preferred embodiment, the pressure difference of the drilling fluid in the drilling fluid return passage in a lower part of the bore hole stretching between the injection fluid injection point and the bottom of the well bore, can be calculated using a hydraulic model taking into account inter alia the well geometry. Since the hydraulic model is herewith only used for calculating the pressure differential over a relatively small section of the bore hole, the precision is expected to be much better than when the pressure differential over the entire well length must be calculated.

Figure 3:
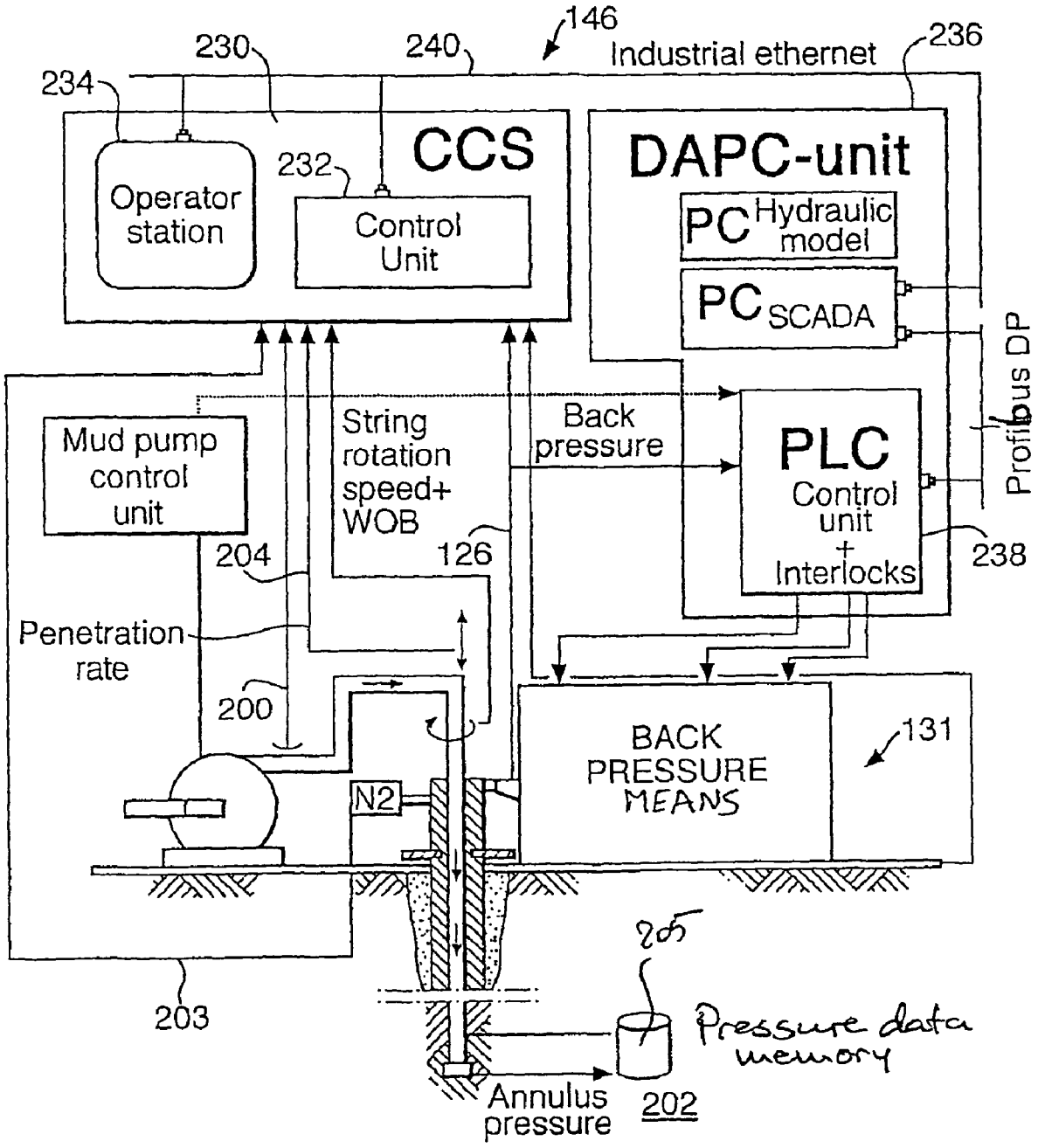
FIG. 3 is a block diagram of the pressure monitoring and control system utilized in an embodiment of the invention.

FIG. 3 is a block diagram of a possible pressure monitoring system 146. System inputs to this monitoring system 146 include the injection fluid pressure 203 that has been measured by the injection fluid pressure sensor 156, and can include the down hole pressure 202 that has been measured by sensor package 119, transmitted by MWD pulser package 122 (or other telemetry system) and received by transducer equipment (not shown) on the surface. Other system inputs include pump pressure 200, input flow rate 204 from flow meter 152 or from mud pump strokes compensated for efficiency, penetration rate and string rotation rate, as well as weight on bit (WOB) and torque on bit (TOB) that may be transmitted from the BHA 113 up the annulus as a pressure pulse. Return flow is optionally measured using flow meter 126, if provided.

Signals representative of the data inputs are transmitted to a control unit (CCS) 230, which is in it self comprised of a drill rig control unit 232, one or more drilling operator's stations 234, a dynamic annular pressure control (DAPC) processor 236 and a back pressure programmable logic controller (PLC) 238, all of which are connected by a common data network or industrial type bus 240. In particular, the CCS 230 is arranged to receive and collect data and make the data accessible via the common data network or industrial type bus 240 to the DAPC processor 236.

The DAPC processor 236 can suitably be a personal computer based SCADA system running a hydraulic model and connected to the PLC 238. The DAPC processor 236 serves three functions, monitoring the state of the borehole pressure during drilling operations, predicting borehole response to continued drilling, and issuing commands to the backpressure PLC to control the back pressure means 131. In addition, commands may also be issued to one or more of the primary pump means 138 and the injection fluid injection system. The specific logic associated with the DAPC processor 236 will be discussed further below.

A schematic model of the functionality of the DAPC pressure monitoring system 146 is set forth in FIG. 4. The DAPC processor 236 includes programming to carry out control functions and Real Time Model Calibration functions. The DAPC processor receives input data from various sources and continuously calculates in real time the correct backpressure set-point to achieve the desired down hole pressure. The set-point is then transferred to the programmable logic controller 238, which generates the control signals for controlling the back pressure means 131.

Still referring to FIG. 4, the pressure 263 in the annulus at the injection fluid injection depth is determined by means of a control module 259, thereby utilizing some fixed well parameters 250 including depth of the injection point 144, and some fixed injection fluid data 255 such as specific mass of the injection fluid, and some variable injection fluid injection data 257 including at least pressure signal 203 generated by injection fluid pressure sensor 156 and optionally data such as the injection fluid injection rate. Suitably, the injection fluid supply passage 141 is led to the surface level on the rig, so that data generated by the injection fluid pressure sensor 156 is readily available as input signal for the back pressure control system.

When N2, or another suitable gas, is used as the injection fluid, the pressure in the annulus 115 at the injection depth can be assumed to be equal to the injection fluid pressure at surface compensated for the weight of the injection fluid column. When a liquid is used at any appreciable injection rate, a dynamic pressure loss must be taken into account as well.

The pressure differential 262 over a lower part of the annulus, the lower part stretching between the injection point 144 and the bottom hole vicinity, is added to the pressure 263 at the injection point 144.

The input parameters for determining this pressure differential fall into three main groups. The first are relatively fixed parameters 250, including parameters such as well, drill string, hole and casing geometry, drill bit nozzle diameters, and well trajectory. While it is recognized that the actual well trajectory may vary from the planned trajectory, the variance may be taken into account with a correction to the planned trajectory. Also within this group of parameters are temperature profile of the fluid in the annulus and the fluid composition. As with the geometrical parameters, these are generally known and do not vary quickly over the course of the drilling operations. In particular, with the DAPC system, one objective is keeping the drilling fluid 150 density and composition relatively constant, using backpressure to provide the additional pressure for control of the annulus pressure.

The second group of parameters 252 are highly variable in nature and are sensed and logged in real time. The rig data acquisition system provides this information via common data network 240 to the DAPC processor 236. This information includes injection fluid pressure data 203 generated by injection fluid pressure sensor 156, flow rate data provided by both down hole and return flow meters 152 and 126 and/or by measurement of pump strokes, respectively, the drill string rate of penetration (ROP) or velocity, the drill string rotational velocity, the bit depth, and the well depth, all the latter being derived from direct rig sensor measurements.

Furthermore, referring to FIGS. 1 and 4, down hole pressure data 254 is provided by a pressure-sensing tool 116, optionally via pressure data memory 205, located in the bottom hole assembly 113. Data gathered with this tool is transmitted to surface by the down hole telemetry package 122. It is appreciated that most of current telemetry systems have limited data transmission capacity and/or velocity. The measured pressure data could therefore be received at surface with some delay. Other system input parameters are the desired set-point for the down hole pressure 256 and the depth at which the set-point should be maintained. This information is usually provided by the operator.

A control module 258 calculates the pressure in the annulus over the lower part well bore length stretching between the injection point 144 and the bottom hole utilizing various models. The pressure differential in the well bore is a function not only of the static pressure or weight of the relevant fluid column in the well, but also includes pressures losses caused by drilling operations, including fluid displacement by the drill string, frictional pressure losses caused by fluid motion in the annulus, and other factors. In order to calculate the pressure within the well, the control module 258 considers the relevant part of the well as a finite number of elements, each assigned to a relevant segment of well bore length. In each of the elements the dynamic pressure and the fluid weight is calculated and used to determine the pressure differential 262 for the segment. The segments are summed and the pressure differential for at least the lower end of the well profile is determined.

It is known that the velocity of the fluid in the well bore is proportional to the flow rate of the fluid 150 being pumped down hole plus the fluid flow produced from the formation 104 below the injection point 144, the latter contribution being relevant for under-balanced conditions. A measurement of the pumped flow and an estimate of the fluid produced from the formation 104 are used to calculate the total flow through the bore hole and the corresponding dynamic pressure loss. The calculation is made for a series of segments of the well, taking into account the fluid compressibility, estimated cutting loading and the thermal expansion of the fluid for the specified segment, which is itself related to the temperature profile for that segment of the well. The fluid viscosity at the temperature profile for the segment is also instrumental in determining dynamic pressure losses for the segment. The composition of the fluid is also considered in determining compressibility and the thermal expansion coefficient. The drill string movement, in particular its rate of penetration (ROP), is related to the surge and swab pressures encountered during drilling operations as the drill string is moved into or out of the borehole. The drill string rotation is also used to determine dynamic pressure losses, as it creates a frictional force between the fluid in the annulus and the drill string. The bit depth, well depth, and well/string geometry are all used to help create the borehole segments to be modelled.

In order to calculate the weight of the drilling fluid contained in the well, the preferred embodiment considers not only the hydrostatic pressure exerted by fluid 150, but also the fluid compression, fluid thermal expansion and the cuttings loading of the fluid seen during operations. All of these factors go into a calculation of the "static pressure".

Dynamic pressure considers many of the same factors in determining static pressure. However, it further considers a number of other factors. Among them is the concept of laminar versus turbulent flow. The flow characteristics are a function of the estimated roughness, hole and string geometry and the flow velocity, density and viscosity of the fluid. The above includes borehole eccentricity and specific drill pipe geometry (box/pin upsets) that affect the flow velocity seen in the borehole annulus. The dynamic pressure calculation further includes cuttings accumulation down hole, string movement's (axial movement and rotation) effect on dynamic pressure of the fluid.

The pressure differential for the entire annulus is determined in accordance with the above, and compared to the set-point pressure 256 in the control module 264. The desired backpressure 266 is then determined and passed on to a programmable logic controller 238, which generates back pressure control signals.

The above discussion of how backpressure is generally calculated utilized several down hole parameters, including down hole pressure and estimates of fluid viscosity and fluid density. These parameters can be determined down hole, for instance using sensor package 119, and transmitted up the mud column using pressure pulses that travel to surface at approximately the speed of sound, for instance by means of telemetry system 122. This travelling speed and the limited bandwidth of such systems usually cause a delay between measuring the data down hole and receiving the data at surface. This delay can range from a few seconds up to several minutes. Consequently, down hole pressure measurements can often not be input to the DAPC model on a real time basis. Accordingly, it will be appreciated that there is likely to be a difference between the measured down hole pressure, when transmitted up to the surface, and the predicted down hole pressure for that depth at the time the data is received at surface.

For this reason, the down hole pressure data is preferably time stamped or depth stamped to allow the control system to synchronize the received pressure data with historical pressure predictions stored in memory. Based on the synchronised historical data, the DAPC system uses a regression method to compute adjustments to some input parameters to obtain the best correlation between predictions and measurements of down hole pressure. The corrections to input parameters may be made by varying any of the available variable input parameters. In the preferred embodiment, only the fluid density and the fluid viscosity are modified in order to correct the predicted down hole pressure. Further, in the present embodiment the actual down hole pressure measurement is used only to calibrate the calculated down hole pressure. It is not utilized to directly adjust the backpressure set-point.

Figure 5:
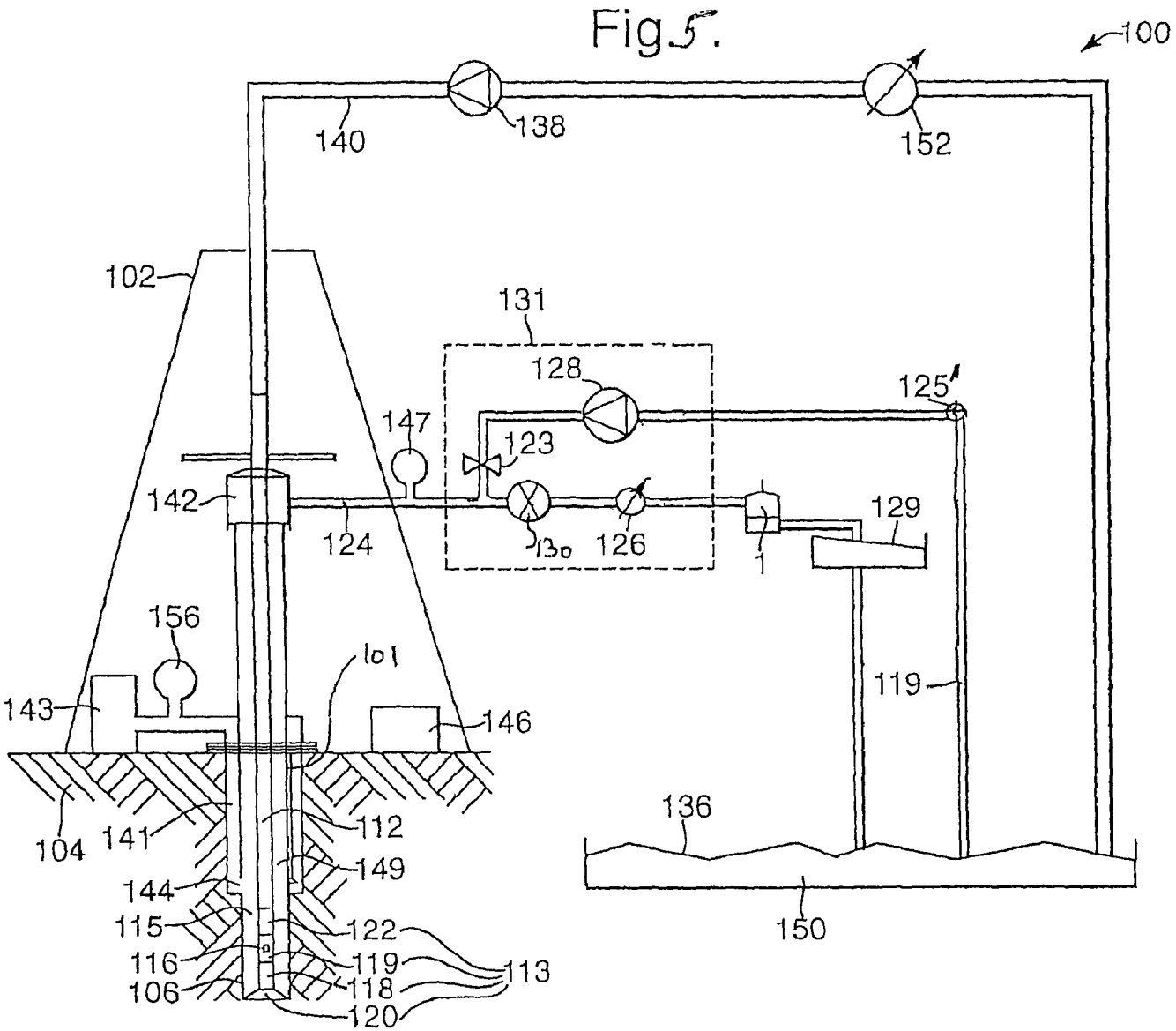
FIG. 5 is a schematic view of a drilling apparatus according to another embodiment of the invention.

FIG. 5 shows an alternative embodiment of a drilling system employing the invention. In addition to the features already shown and described with reference to the embodiment of FIGS. 1 to 4, the system of FIG. 5 includes a back pressure system 131 that is provided with pressurizing means, here shown in the form of back pressure pump 128, in parallel fluid communication with the drilling fluid return passage 115 and the choke 130, to pressurize the drilling fluid in the drilling fluid discharge conduit 124 upstream of the flow restrictive device 130. The low-pressure end of the back pressure pump 128 is connected, via conduit 119, to a drilling fluid supply which may be in communication with reservoir 136. Stop valve 125' may be provided in conduit 119 to isolate the back pressure pump 128 from the drilling fluid supply.

Optionally, valve 123 may be provided to selectively isolate the back pressure pump 128 from the drilling fluid discharge system.

Back pressure pump 128 can be engaged to ensure that sufficient flow passes the choke system 130 to be able to maintain backpressure, even when there is insufficient flow coming from the annulus 115 to maintain pressure on choke 130. However, in UBD operations it may often suffice to increase the weight of the fluid contained in the upper part 149 of the well bore annulus by turning down the injection fluid injection rate when the circulation rate of drilling fluid 150 via the drill string 112 is reduced or interrupted.

The back pressure control means in this embodiment can generate the control signals for the back pressure system, suitably adjusting not only the variable choke 130 but also the back pressure pump 128 and/or valve 123.

Figure 6:
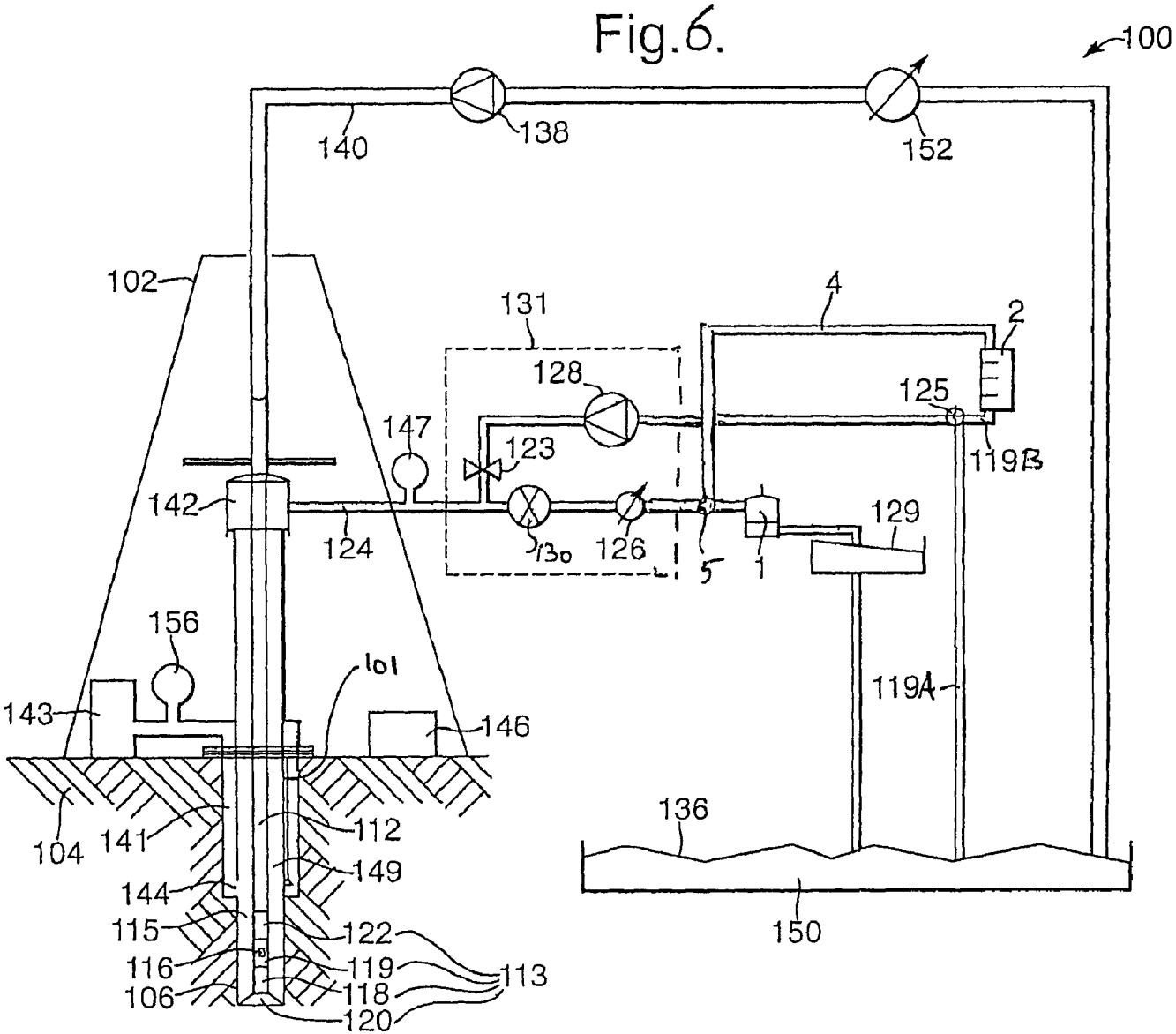
FIG. 6 is a schematic view of a drilling apparatus according to yet another embodiment of the invention.

FIG. 6 shows still another embodiment of the drilling system, wherein in addition to the features of FIG. 5, the drilling fluid reservoir comprises a trip tank 2 in addition to the mud pit. A trip tank is normally used on a rig to monitor fluid gains and losses during tripping operations. It is remarked that the trip tank may not be utilized that much when drilling using a multiphase fluid system such as described hereinabove involving injection of a gas into the drilling fluid return stream, because the well may often remain alive or the drilling fluid level in the well drops when the injection gas pressure is bled off. However, in the present embodiment the functionality of the trip tank is maintained, for instance for occasions where a high-density drilling fluid is pumped down instead in high-pressure wells.

A manifold of valves is provided downstream of the back pressure system 131, to enable selection of the reservoir to which drilling mud returning from the well bore is directed. In the embodiment of FIG. 5, the manifold of valves includes two way valve 5, allowing drilling fluid returning from the well or to be directed to the mud pit 136 or the trip tank 2.

The back pressure pump 128 and valve 123 are optionally added to this embodiment.

The manifold of valves may also include a two way valve 125 provided for either feeding drilling fluid 150 from reservoir 136 via conduit 119A or from reservoir 2 via conduit 119B to a backpressure pump 128 optionally provided in parallel fluid communication with the drilling fluid return passage 115 and the choke 130.

In operation, valve 125 would select either conduit 119A or conduit 119B, and the backpressure pump 128 engaged to ensure sufficient flow passes the choke system to be able to maintain backpressure, even when there is no flow coming from the annulus 115.

Unlike the drilling fluid passage inside the drill string, the injection fluid supply passage can preferably be dedicated to one task, which is supplying the injection fluid for injection into the drilling fluid gap. This way, its hydrostatic and hydrodynamic interaction with the injection fluid can be accurately determined and kept constant during an operation, so that the weight of the injection fluid and dynamic pressure loss in the supply passage can be accurately established.

Embodiments of the invention are at least applicable to pressure control during under-balanced drilling operations, at-balance drilling operations, over-balance drilling operations or completion operations.

It will be understood that the invention is enabled with only one injection fluid pressure sensor, but that a plurality of injection fluid pressure sensors can be utilized, if so desired, for instance positioned in mutually different locations.

It is remarked that WO 02/084067 describes a drilling well configuration wherein the drilling fluid gap is formed by an inner well bore annulus, and an injection fluid supply passage is provided in the form of a second, outer annulus, for bringing the injection fluid from the surface level to a desired injection depth. Fluid is injected into the inner annulus for dynamically controlling bottom hole circulation pressure in the well bore wherein a high injection rate of a light fluid results in a low bottom hole pressure.

In contrast, the present patent application utilizes back pressure means for controlling the bottom hole pressure, whereby the injection fluid injection pressure is utilized for controlling the back pressure means. It has been found that, by controlling back pressure means in response of the injection fluid injection pressure, the down hole pressure is more accurately controllable and more stable than by controlling the down hole pressure by directly regulating the injection fluid injection rate.

Nevertheless, the injection fluid injection rate may be controlled in concert with controlling the back pressure means. This is of particular advantage when starting or stopping circulation in order to avoid the injection fluid injection rate being maintained at unrealistic values.

In order to facilitate the accuracy of bottom hole pressure determination, the injection fluid is preferably injected as close as possible to the bottom of the bore hole.

The injection fluid supply passage is preferably led to or close to the surface level from where the drill string reaches into the bore hole, thereby providing an opportunity to generate the pressure signal at surface or close to the surface. This is more convenient, and in particular allows for faster monitoring of the pressure signal, than when the pressure signal would be generated at great depth below the surface level.

The injection fluid can be a liquid or a gas. Preferably, the injection fluid injection system is arranged to inject an injection fluid having a mass density lower than that of the drilling fluid. By injecting a lower density injection fluid, the hydrostatic component to the down hole pressure is reduced. This allows for a higher dynamic range of control for the back pressure means.

However, the injection fluid is preferably provided in the form of a gas, particularly an inert gas such as for example nitrogen gas (N2). The dynamic pressure loss of the gas in the injection fluid supply passage can optionally be taken into account, but its contribution to the pressure signal is expected to be low compared to the weight of the gas column. Thus, the gas pressure compensated for the weight of the gas column may for practical purposes be assumed to be almost equal to the drilling fluid pressure in the drilling fluid gap at the injection depth.

In the embodiments shown and/or described above, the injection fluid supply passage is provided in the form of an outer annulus. The injection fluid supply passage may also be provided in a different form, for instance via a drill pipe gas injection system. This option is particularly advantageous when an outer annulus is no available for fluid injection. But more importantly, this option allows for the injection fluid injection point 144 to be located very close to the bottom of the hole so that the injection fluid pressure in the injection fluid supply passage gives an accurate parameter as a starting point for establishing an accurate value for the bottom hole pressure. Nevertheless, an electro-magnetic MWD sensor suite may be employed for pressure readout to be used in the same manner as described above to calibrate a hydraulics model.

We claim:

1. A drilling system for drilling a bore hole into an earth formation, the bore hole having an inside wall, whereby the drilling system comprises:

a drill string reaching into the bore hole leaving a drilling fluid return passage between the drill string and the bore hole inside wall;

a drilling fluid discharge conduit in fluid communication with the drilling fluid return passage;

pump means for pumping a drilling fluid through the drill string into the bore hole and to the drilling fluid discharge conduit via the drilling fluid return passage;

back pressure means for controlling the drilling fluid back pressure;

an injection fluid injection system comprising an injection fluid supply passage fluidly connecting an injection fluid supply with the drilling fluid return passage and further comprising an injection fluid pressure sensor arranged to provide a pressure signal in accordance with an injection fluid pressure in the injection fluid supply passage;

back pressure control means for controlling the back pressure means whereby the back pressure control means is arranged to receive the pressure signal and to regulate the back pressure means in dependence of at least the pressure signal.

2. The drilling system according to claim 1, wherein the drill string reaches into the bore hole from a surface level and the injection fluid pressure sensor is provided on or close to the surface level.

3. The drilling system according to claim 1, wherein the back pressure means are arranged to control the discharge of drilling fluid from the drilling fluid return passage.

4. The drilling system according to claim 1, wherein the back pressure means comprises a variable flow restrictive device arranged in a path for the flow of drilling fluid downstream of a point where the injection fluid supply passage connects to the drilling fluid return passage.

5. The drilling system according to claim 1, wherein the fluid injection means is arranged to inject an injection fluid having a mass density different from that of the drilling fluid.

6. The drilling system according to claim 5, wherein the injection fluid has a mass density that is lower than that of the drilling fluid.

7. The drilling system according to claim 1, wherein the fluid injection means is arranged to inject an injection fluid in the form of a gas.

8. The drilling system according to claim 1, wherein the back pressure control means comprises a programmable pressure monitoring and control system arranged to calculate a predicted down hole pressure using a model and thereby utilising least the pressure signal, compare the predicted down hole pressure to a desired down hole pressure, and to utilize the differential between the calculated and desired pressures to control said fluid back pressure means.

9. The drilling system according to claim 8, wherein a bottom hole assembly is provided on a lower end of the drill string, the bottom hole assembly comprising a down hole sensor and a down hole telemetry system for transmitting data, including down hole sensor data, the down hole sensor data at least representing down hole pressure data, and the system further comprises a surface telemetry system for receiving the down hole sensor data, and the programmable pressure monitoring and control system is arranged to compare the predicted down hole pressure with the down hole sensor data.

10. The drilling system according to claim 1, wherein a bottom hole assembly is provided on a lower end of the drill string, the bottom hole assembly comprising a down hole sensor and a down hole telemetry system for transmitting data, including down hole sensor data, the down hole sensor data at least representing down hole pressure data, and the system further comprises a surface telemetry system for receiving the down hole sensor data.

11. The drilling system according to claim 1, wherein the injection fluid supply passage comprises an outer annulus in a cased section of the bore hole.

12. A method of drilling a bore hole into an earth formation, the bore hole having an inside wall, the method comprising the steps of:

deploying a drill string into the bore hole and forming a drilling fluid return passage between the drill string and the bore hole inside wall;

pumping a drilling fluid through the drill string into the bore hole and via the drilling fluid return passage to a drilling fluid discharge conduit arranged in fluid communication with the drilling fluid return passage;

controlling a drilling fluid back pressure by controlling back pressure means;

injecting an injection fluid from an injection fluid supply via an injection fluid supply passage into the drilling fluid in the drilling fluid return passage;

generating a pressure signal in accordance with an injection fluid pressure in the injection fluid supply passage;

controlling the back pressure means, which controlling comprises regulating the back pressure means in responsive to at least the pressure signal.

13. The method according to claim 12, wherein the drill string is being deployed into the bore hole from a surface level and wherein generating the pressure signal comprises operating an injection fluid pressure sensor that has been provided in the injection fluid supply passage on or close to the surface level.

14. The method according to claim 12, wherein controlling the backpressure means comprises controlling a discharge of the drilling fluid from the drilling fluid return passage.

15. The method according to claim 12, wherein controlling the backpressure means comprises controlling a variable flow restrictive device arranged in a path for the flow of drilling fluid downstream of a point where the injection fluid supply passage is being injected.

16. The method according to claim 12, wherein the injection fluid has a mass density different from that of the drilling fluid.

17. The method according to claim 12, wherein the injection fluid has a mass density that is lower than that of the drilling fluid.

18. The method according to claim 12, wherein the injection fluid comprises a gas.

19. The method according to claim 12, wherein controlling the drilling fluid back pressure comprises:

calculating a predicted down hole pressure using a model and thereby utilising least the pressure signal;

comparing the predicted down hole pressure to a desired down hole pressure; and utilizing the differential between the calculated and desired pressures to control said fluid back pressure means.

* * * * *